US006502244B1

(12) United States Patent
Kleinert

(10) Patent No.: US 6,502,244 B1
(45) Date of Patent: Jan. 7, 2003

(54) GLOVE WITH TAPERED FINGERS

(75) Inventor: James M. Kleinert, Louisville, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 10/003,893

(22) Filed: Oct. 25, 2001

(51) Int. Cl.[7] ..... A41D 19/00
(52) U.S. Cl. ..... 2/163; 2/161.6
(58) Field of Search ..... 2/16, 161.1, 161.2–161.6, 2/163, 169

(56) References Cited

U.S. PATENT DOCUMENTS 4,850,053 A * 7/1989 Tepley et al. ..... 2/161
5,016,286 A * 5/1991 Henriksen ..... 2/161
5,195,188 A * 3/1993 Bourdeau et al. ..... 2/161
5,697,103 A * 12/1997 Wiggins ..... 2/159

* cited by examiner

*Primary Examiner*—John J. Calvert
*Assistant Examiner*—Katherine Moran
(74) *Attorney, Agent, or Firm*—Charles G. Lamb; Middleton Reutlinger

(57) ABSTRACT

A glove includes a plurality of separated elongated sections to receive a plurality of fingers and a thumb therein, said elongated finger sections being tapered toward a longitudinal axis extending between a long finger section and a ring finger section so that when the elongated finger sections are in a flexed condition, the finger sections point to an area of the wrist including the scaphoid.

8 Claims, 6 Drawing Sheets

GLOVE WITH TAPERED FINGERS

BACKGROUND OF THE INVENTION

Field of the Invention

This invention relates to gloves for the human hand and more particularly relates to a glove having tapered finger sections to accommodate the anatomical structure and natural movement of rotation at the proximal interphalangeal joints of the fingers.

Glove construction for protection of the human hand is well known. Particularly, gloves are made to both protect the hand in the environment in which the user is going to be active, that being, for example, work, play, such as baseball, hockey and the like, as well as to protect the wearer when exposed to frigid temperatures. In the manufacture of gloves, it has been a tendency to assume that each finger section is straight and that fingers are anatomically straight and in parallel with each other. Thus, gloves are made with straight finger sections and the finger sections are generally in parallel. That is, when basic glove patterns are cut, they are done so with the finger sections cut to be relatively straight and in parallel. However, in the anatomy of the hands, particularly the fingers, there is a natural tendency of the four fingers, (index, long, ring, and small) to point towards the scaphoid bone in the wrist when the fingers are in flexion. In order words, the long axes of the fingers tend to converge near the wrist when they are closed in a fist. This convergence is secondary to the natural adduction of about 5° and the rotation of about 9° that occurs at the proximal interphalangeal joints of the fingers. These joints do not only function as a hinge joint, but there is also a component of rotation that occurs with joint flexion. This convergence is the motion of the joint towards the midline and the midline can be simply described as an imaginary line between the long and ring fingers. Each finger tends to lean approximately 5° towards this midline, especially with joint flexion. Thus, coupled with the natural rotation of the fingers which also occurs with flexion determines that the fingers tend to point to the same area on the wrist, namely, the scaphoid.

SUMMARY OF THE INVENTION

It is an object of the present invention to provide gloves and patterns for gloves that allow for the natural adduction and rotation that occurs with finger flexion.

It is another object of the present invention to provide a glove having finger sections therein to allow rotation of the finger naturally when the fingers are in a hand closure condition.

It is even another object of the present invention to provide gloves with finger sections which are at an angle of between 5° and 9° at the proximal interphalangeal joints.

More particularly, the present invention provides a glove for a human hand with separated elongated sections to receive a plurality of fingers and a thumb therein. The glove includes a covering having a top portion for covering a back side of the hand, including a top side of the elongated sections to receive a plurality of fingers and a lower portion to cover a palmar side of the hand which includes a bottom side of the elongated sections to receive the plurality of fingers therein. The elongated sections include an index finger section, a long finger section, a ring finger section, and a small finger section. The covering has a first longitudinal axis between the long finger section and the ring finger section wherein the covering for each of the finger sections is angled toward the longitudinal axis.

Further objects and advantages of the present invention will appear from the following description and appended claims, reference being had to the accompanying drawings forming a part of the specification wherein like reference characters designate corresponding parts into several views.

BRIEF DESCRIPTION OF THE DRAWINGS

A better understanding of the invention will be had upon reference to the following description in conjunction with the accompanying drawings in which like numerals refer to like parts throughout the several views and wherein.

DESCRIPTION OF THE PREFERRED EMBODIMENT

Figure 1:
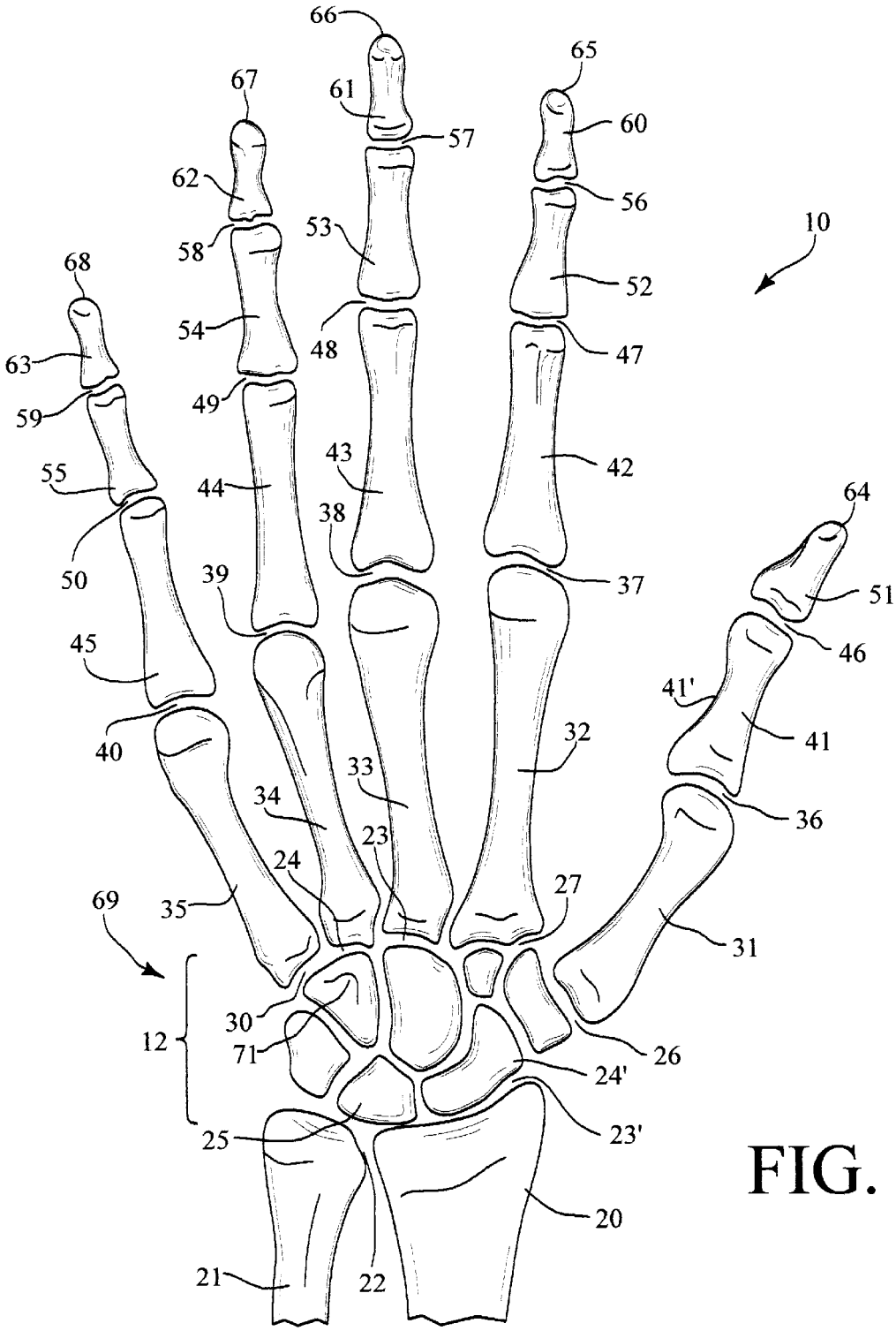
FIG. 1 is a bottom schematic anatomical view of the bones of a right-side human hand showing the palm-side details.

FIG. 1 is a schematic anatomical view of the bones of a right human hand 10 looking at a palm 18 side. Shown are the radius 20, ulna 21, radiocarpal joint (RC) 23', distal radio ulnar joint (DRUJ) 22, wrist 12, thumb 64, index finger 65, long finger 66, ring finger 67, and small finger 68. The carpus 69 comprises eight carpal bones, seven of which are shown in FIG. 1 and includes the hamate bone 71 with its hook-like protrusion, the scaphoid 24' and the lunate 25.

The thumb 64 is comprised of the distal phalanx 51, the interphalangeal joint (IP) 46, proximal phalanx 41, diaphysis of proximal phalanx 41', metacarpophalangeal joint (MCP) 36, metacarpal 31, and carpometacarpal joint (CMC) 26.

The index finger 65 is comprised of the distal phalanx 60, distal interphalangeal joint (DIP) 56, middle phalanx 52, proximal interphalangeal joint (PIP) 47, proximal phalanx 42, metacarpophalangeal joint (MCP) 37, metacarpal 32, and carpometacarpal joint (CMC) 27.

The long finger 66 is comprised of the distal phalanx 61, distal interphalangeal joint (DIP) 57, middle phalanx 53, proximal interphalangeal joint (PIP) 48, proximal phalanx 43, metacarpophalangeal joint (MCP) 38, metacarpal 33, and carpometacarpal joint (CMC) 23.

The ring finger 67 is comprised of the distal phalanx 62, distal interphalangeal joint (DIP) 58, middle phalanx 54, proximal interphalangeal joint (PIP) 49, proximal phalanx 44, metacarpophalangeal joint (MCP) 39, metacarpal 34, and carpometacarpal joint (CMC) 24.

The small finger 68 is comprised of the distal phalanx 63, distal interphalangeal joint (DIP) 59, middle phalanx 55, proximal interphalangeal joint (PIP) 50, proximal phalanx 45, metacarpophalangeal joint (MCP) 40, metacarpal 35, and carpometacarpal joint (CMC) 30.

Figure 1A:
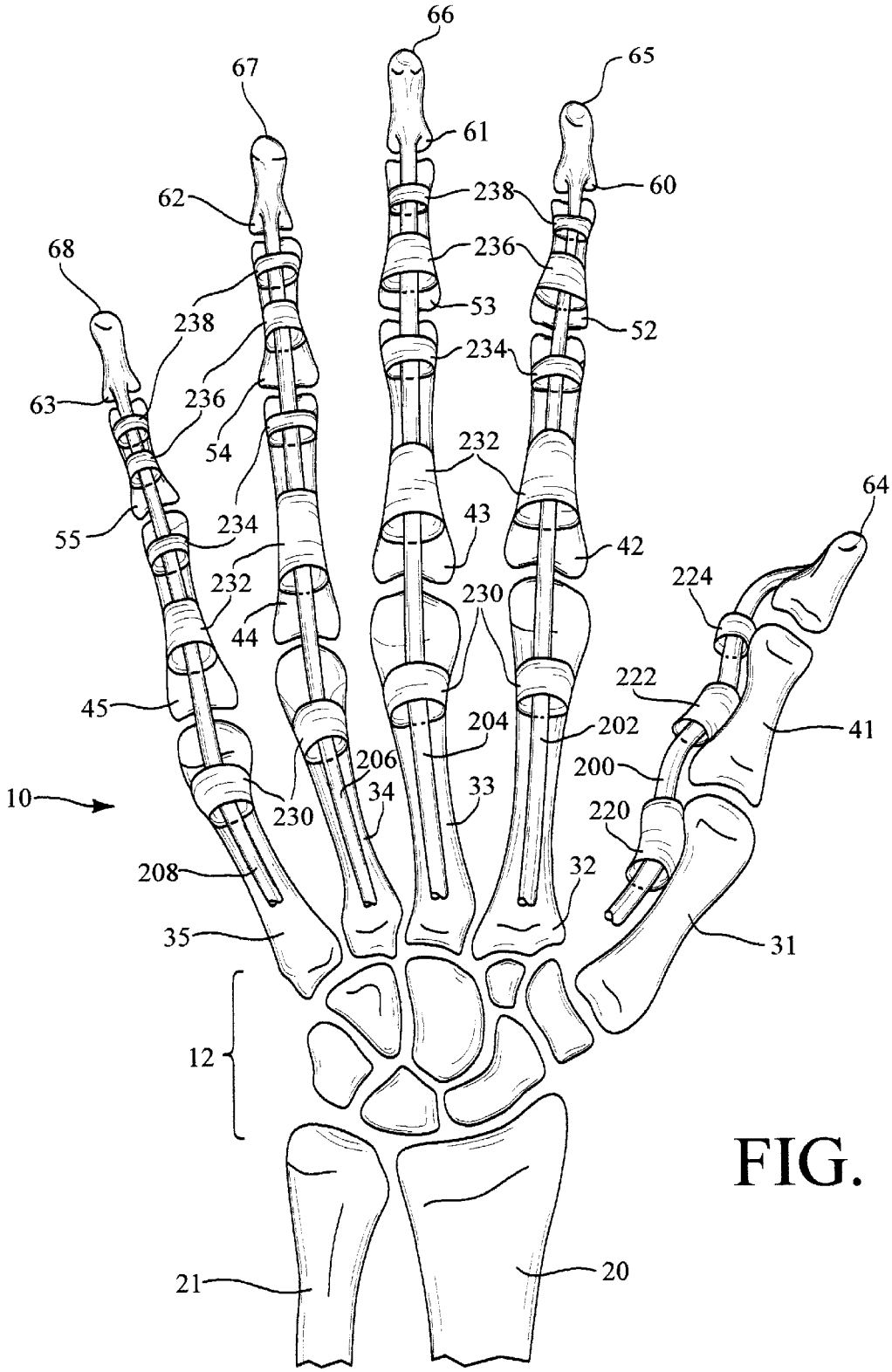
FIG. 1A is a bottom schematic anatomical palm-side view of the bones, and selected details of the pulleys and tendons of a right-side human hand.

FIG. 1A shows the skeletal anatomy, pulley system, and flexor tendons of the thumb 64 and fingers 65–68 of the right hand 10. The thumb 64 includes the flexor tendon (flexor pollicis longus) 200 and the three pulleys 220–224 of the thumb 64; an A1 pulley 220, A2 pulley 222, and A3 pulley 224. The A2 pulley 222 is the most important for function and is attached to the proximal phalanx 41 of the thumb 64. The respective pulleys 230–238 are also shown for each of the: index finger 65, long finger 66, ring finger 67, and small finger 68. Each finger 65–68 has five pulleys 230–238; an Al pulley 230, A2 pulley 232, A3 pulley 234, A4 pulley 236, and A5 pulley 238. The A2 pulley 232 and A4 pulley 236 are considered to be the most important for function. The A2 pulley 232 is attached to the proximal phalanx 42–45. The A4 pulley 236 is attached to the middle phalanx 52–55. The A1 pulley 230 is near the MCP joint 37–40, the A3 pulley 234 is near the PIP joint 47–50 and the A5 pulley 238 is near the DIP joint 56–59.

The flexor tendons 202–208 are shown as one unit for each finger 65–68, but actually there are two flexor tendons to each unit. They are the flexor digitorum superficialis and the flexor digitorum profundus (shown as one, 202–208). These tendons 202–208 travel underneath the pulleys 230–238 and attach to the distal phalanx 60–63 of each finger 65–68. The tendons 202–208 move back and forth below the pulleys 230–238, via muscles (not shown) attached to the proximal end of the tendons. This movement of the tendon 202–208 produces finger 65–68 flexion. The pulleys 230–238 prevent the flexor tendons 202–208 from bowstringing or moving away from the bone with finger 65–68 flexion. If the pulleys 230–238 are damaged and no longer function, the tendons 202–208 will bowstring with a resultant significant loss of finger motion as well as grip strength. As such, pulleys 230–238, especially the A2 pulley 232 and the A4 pulley 236, are very important and must be preserved and protected as much as possible.

Figure 2:
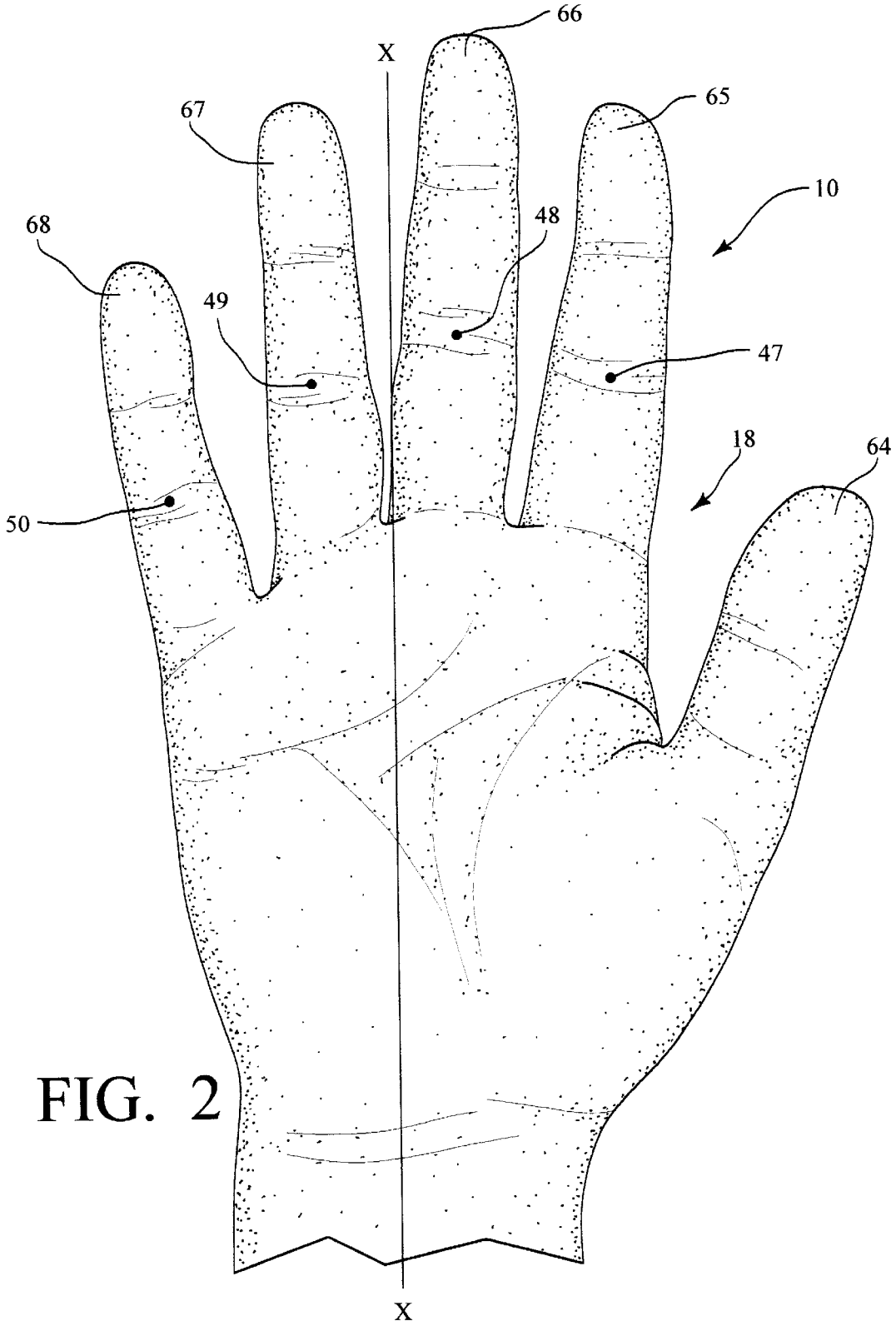
FIG. 2 is a palmar side view of a human hand with the fingers shown in an extended position.

In FIG. 2 is shown the right human hand 10 looking at a palm 18 side wherein the fingers 65, 66, 67, and 68 are shown in an extended condition. The midline X—X is shown as an imaginary line between the long finger 66 and the ring finger 67. And, as shown, the fingers 65, 66, 67, and 68 lean toward this midline. This convergence is generally from about 5° to 9° and occurs at approximately the interphalangeal joints 47, 48, 49 and 50 of the fingers 65, 66, 67, and 68, respectively.

Figure 2A:
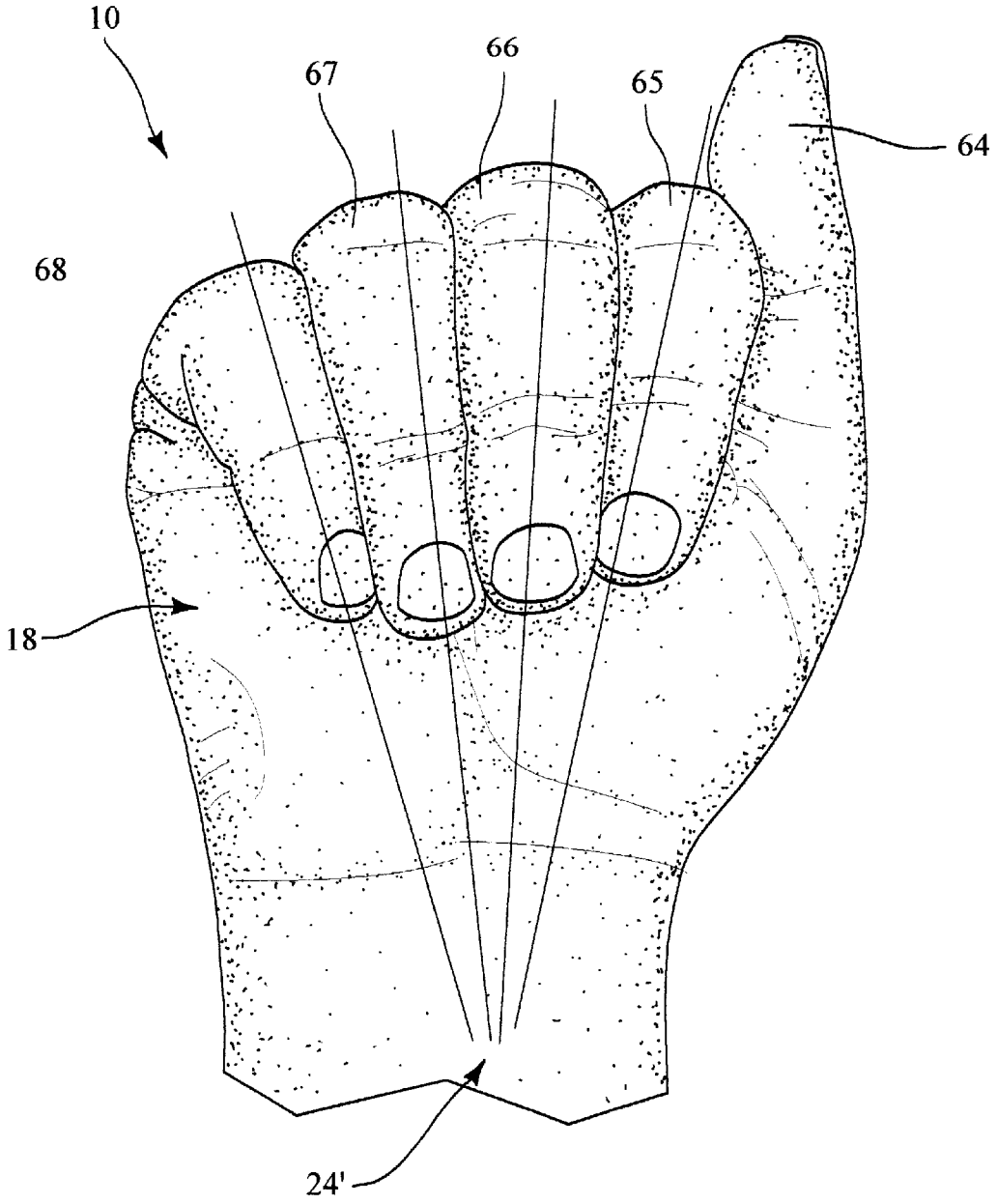
FIG. 2A is a palmar side view of a human hand showing the fingers in flexion.

As shown in FIG. 2A, in the flexion or bending of the fingers into a fist, the fingers 65, 66, 67 and 68 point to the same area of the wrist, which is in the area of the scaphoid 24.

Figure 3:
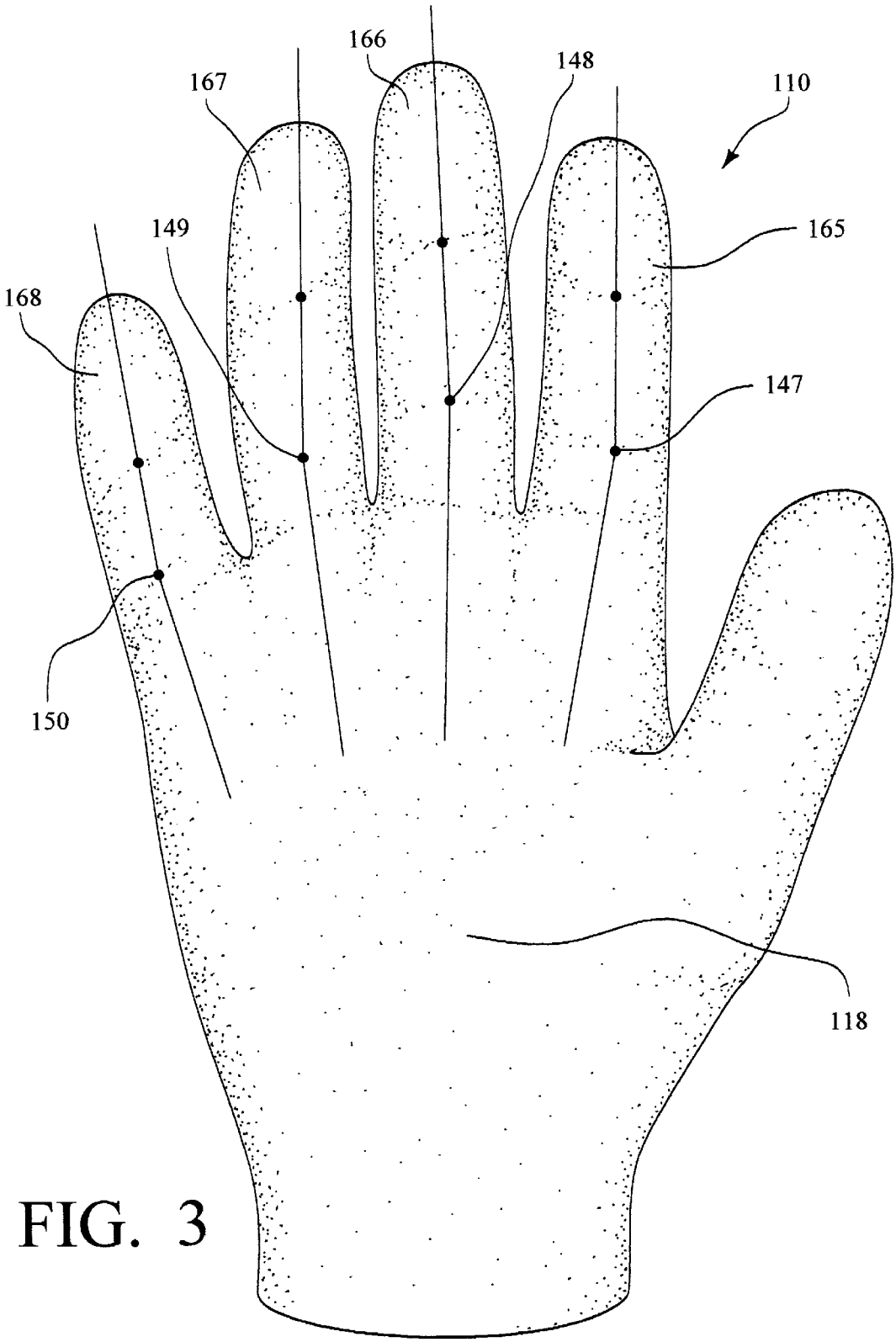
FIG. 3 is a plan view of a pattern for a palmar side of a glove.

As shown in FIG. 3, a pattern 118 for the palmar side of a glove 110 is shown and includes finger sections for each finger. A finger section for the index finger is identified by the numeral 165, the pattern for the long finger section is identified by the numeral 166, the finger section for the ring finger is identified by the numeral 167, and the finger section for the small finger is identified by the numeral 168. The finger sections are cut at an angle at approximately the center axis of rotation of the proximal interphalangeal joints. These angles will vary from 5° to 9° towards the midline X—X, as shown in FIG. 2. This angle of deflection for each of the finger sections occurs at approximately the center axis of rotation of the proximal interphalangeal joint, as indicated by the numeral 147 for the center axis of rotation of the proximal interphalangeal joint for the index finger, at the location identified by the numeral 148 for the center axis of rotation of the proximal interphalangeal joint for the long finger, at the location identified by the numeral 149 for the center axis of rotation of the proximal interphalangeal joint of the ring finger, and at a location identified by the numeral 150 for the center axis of rotation of the proximal interphalangeal joint of the small finger.

Figure 4:
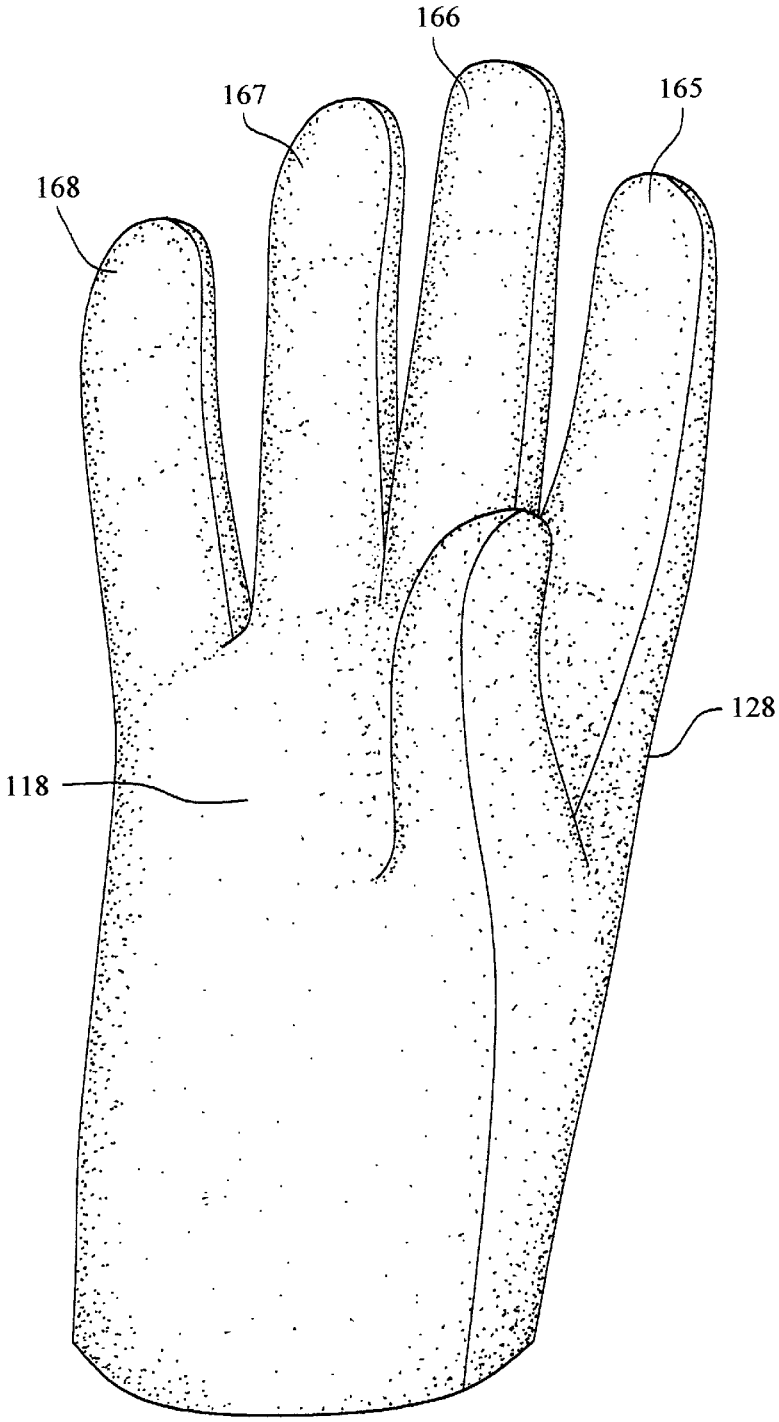
FIG. 4 is a perspective view of a glove of the present invention.

As shown in FIG. 4, a completed glove construction 130 of the present invention uses the pattern as shown in FIG. 3 which includes a back covering 128 which is a mirror image of the palmar side pattern 118 of FIG. 3 and a palmar side covering 148, the palmar side covering being made in accordance with the palmar side pattern 118.

As shown, the glove and glove pattern of the present invention may be used in gloves for work, for play, and for use in a cold environment. Moreover, appropriate padding may be used in selected portions of the glove to protect the wearer for the particular environment in which the glove is to be subjected. For example, in the use as a sport glove, padding may be placed around or on each of the sides above and below the center axis of rotation of the different joints in the fingers and thumb to protect the wearer's tendons and pulleys. Materials of construction used in the manufacture of the glove will also depend upon the type of activity to which the glove is to be used and may include leather, as well as synthetic leather materials, and elastic materials with the thickness and dimensions of the coverings also being dependent upon the activity or environment to which the glove is to be used.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A glove comprising:

a covering for a hand with separate elongated sections to receive a plurality of fingers and a thumb therein, said covering having a top portion for covering a back side of the hand including a top side of said elongated sections to receive a plurality of fingers and a lower portion to cover a palmar side of a hand including a bottom side of said elongated sections to receive said plurality of fingers; said elongated sections including an index finger section, a long finger section, a ring finger section, and a small finger section, said covering having a first longitudinal axis between said long finger section and said ring finger section, said covering for each of said finger sections being angled towards said longitudinal axis, said angle toward said longitudinal axis being such that when said finger sections are in a folded condition the longitudinal extension of the longitudinal axis of each finger section points to an area of a wrist including a scaphoid.

2. The glove of claim 1, said angle toward said longitudinal axis being between 5° and 9°.

3. The glove of claim 1, the angle toward said longitudinal axis being at a center axis of rotation of proximal interphalangeal joint areas for a finger in each of said elongated sections.

4. A pattern for a glove comprising:

a covering for a palmar side of a hand with separate elongated sections to represent a plurality of fingers and a thumb, said elongated sections including an index finger section, a long finger section, a ring finger section, and a small finger section, said covering having a first longitudinal axis between said long finger section and said ring finger section, said covering for each of said finger sections being angled towards said longitudinal axis, said angle toward said longitudinal axis being such that when said finger sections are in a folded condition the longitudinal extension of the longitudinal axis of each finger section points to an area of a wrist including a scaphoid.

5. The pattern of claim 4, said angle toward said longitudinal axis being between 5° and 9°.

6. The pattern of claim 4, the angle toward said longitudinal axis being at a center axis of rotation of proximal interphalangeal joint areas for a finger in each of said elongated sections.

7. A glove comprising:

a covering for a hand with separate elongated sections to receive a plurality of fingers and a thumb therein, said covering having a top portion for covering a back side of the hand including a top side of said elongated sections to receive a plurality of fingers and a lower portion to cover a palmar side of a hand including a bottom side of said elongated sections to receive said plurality of fingers; said elongated sections including an index finger section, a long finger section, a ring finger section, and a small finger section, said covering having a first longitudinal axis between said long finger section and said ring finger section, said covering for each of said finger sections being angled towards said longitudinal axis, said angle toward said longitudinal axis being between 5° and 9°.

8. A pattern for a glove comprising:

a covering for a palmar side of a hand with separate elongated sections to represent a plurality of fingers and a thumb, said elongated sections including an index finger section, a long finger section, a ring finger section, and a small finger section, said covering having a first longitudinal axis between said long finger section and said ring finger section, said angle toward said longitudinal axis between 5° and 9°, said covering for each of said finger sections being angled towards said longitudinal axis.

* * * * *